US007347411B1

(12) United States Patent
Teel et al.

(10) Patent No.: US 7,347,411 B1
(45) Date of Patent: Mar. 25, 2008

(54) SPLAYING SNATCH BLOCK

(75) Inventors: William Teel, Arcadia, CA (US); James Rawlinson, Westminster, CA (US); Jeffrey A. Huber, Villa Park, CA (US)

(73) Assignee: Goodrich Corporation, Charlotte, NC (US)

( * ) Notice: Subject to any disclaimer, the term of this patent is extended or adjusted under 35 U.S.C. 154(b) by 0 days.

(21) Appl. No.: 11/707,644

(22) Filed: Feb. 16, 2007

(51) Int. Cl.
*B66D 3/04* (2006.01)

(52) U.S. Cl. ..... 254/405; 254/402; 254/411

(58) Field of Classification Search ..... 254/401, 254/402, 403, 405, 406, 411
See application file for complete search history.

(56) References Cited

U.S. PATENT DOCUMENTS 1,671,435 A * 5/1928 McKissick ..... 254/402
2,555,059 A 5/1951 Schrader
2,654,571 A * 10/1953 Albright, Jr. ..... 254/405
3,199,841 A 8/1965 McKean
3,372,908 A 3/1968 McCarthy
3,999,739 A 12/1976 Vick et al.
4,325,537 A * 4/1982 Winter et al. ..... 254/405
4,760,993 A * 8/1988 Du Preez ..... 254/411
5,056,760 A * 10/1991 Jorgensen ..... 254/406
5,249,543 A 10/1993 Rutgerson et al.
5,725,200 A 3/1998 Gordon
6,386,516 B1 * 5/2002 Lenders ..... 254/393
6,481,695 B1 11/2002 Fuller

* cited by examiner

*Primary Examiner*—Emmanuel M Marcelo
(74) *Attorney, Agent, or Firm*—Muirhead and Saturnelli, LLC

(57) ABSTRACT

A snatch block for facilitating the movement of loads in loading or unloading operations includes a sheave, two side sections and a top section. The top section is releasably coupled to at least one of the side sections and pivotable with respect to at least one of the side sections. Either or both of the side sections may be rotatable with respect to the sheave. An outer groove of the sheave may be made accessible to receive a fixed-end cable when the side sections are splayed with respect to on another on the sheave. The snatch block may be loadable or unloadable from either side and may be loaded or unloaded when lying flat on the ground.

20 Claims, 5 Drawing Sheets

SPLAYING SNATCH BLOCK

TECHNICAL FIELD

This application is directed to the field of pulley assemblies and, more specifically, to snatch block pulley assemblies.

BACKGROUND OF THE INVENTION

A snatch block is a pulley assembly in which one side may be opened to receive a portion of a cable, chain, rope or other flexible line (generally referred to herein as a "cable") that does not have any available free ends. Snatch blocks are useful, for example, in applications involving the moving, loading and unloading of cargo and other heavy loads for which it may not be practicable to fasten and unfasten cables to and from the load, for example loading or unloading onto or off of ships or aircraft. Snatch blocks may be arranged to allow transport of a load so as to avoid an obstacle in a loading path or to multiply the line pull from a winch or other hoisting device.

Known snatch blocks include a sheave that receives the cable and two side sections positioned on either side of the sheave. A block supporting hook is attached to the snatch block and allows the snatch block to be secured to a support structure. One side of the snatch block is movable with respect to the other side, for example by removing, rotating or swiveling the movable side and thereby allow a cable with fixed ends to be loaded onto the snatch block. (See, for example, U.S. Pat. No. 5,249,543 to Rutgerson, et al., U.S. Pat. No. 4,760,993 to Du Preez, U.S. Pat. No. 3,999,739 to Vick, et al, and U.S. Pat. No. 2,555,059 to Schrader, which are all incorporated herein by reference). Problems that may occur with the use of known snatch blocks include issues involving complexities of configuring snatch block assembly arrangements before and during loading or unloading operations, and the adjustments of line tensions during the loading or unloading operations that may be required to add, remove or modify snatch blocks.

Accordingly, it would be desirable to provide a snatch block that may be relatively easily and quickly used and manipulated to receive a cable or other flexible line.

SUMMARY OF THE INVENTION

According to the system described herein, a snatch block includes a sheave having a first side, a second side and a central axis. A first section is disposed on the first side of the sheave and a second section is disposed on the second side of the sheave. At least one of the first section and the second section is splayable apart with respect to the other one of the first section and the second section. A top section is couplable to the first section and the second section, wherein the top section is releasably coupled to at least one of the first section and the second section and pivotably coupled to at least one of the first section and the second section. One or both of the first section and the second section may be rotatable about the central axis of the sheave. The sheave may include an outer groove and portions of the first section and the second section may be disposed over the outer groove. Profiles of the first section and the second section over the outer groove each has dimensions that allow loading of a fixed-end cable into the outer groove.

The snatch block may further include a first releasable pivot connection that couples the top section to the first section and a second releasable pivot connection that couples the top section to the second section and each of the pivot connections may include a pin rod. The outer groove of the sheave may be made accessible to receive a fixed-end cable when the first sections is splayed apart from the second section. Each of the first section and the second section may include a v-shaped attachment portion that is coupled to the sheave and the top section and a semicircular cover portion that is coupled to the attachment portion and disposed over the outer groove. The snatch block may be loadable or unloadable when the snatch block is lying flat on the ground.

According further to the present system described herein, a method for loading or unloading a snatch block includes providing a snatch block having a sheave, a first side section, a second side section and a top section. The top section is uncoupled from a selected one of the side sections and pivoted away from the selected one of the side sections. The selected one of the side sections is then splayed apart with respect to the other side sections to allow a fixed-end cable to be loaded onto or unloaded from the sheave. The top section may be pivotable with respect to either or both of the side sections. One or both of the first side section and the second side section may be rotatable about a central axis of the sheave. After loading or unloading the fixed-end cable onto or off of the sheave, the selected one of the side sections is rotated into alignment with the other of the side sections and the top section is recoupled to the selected one of the side sections. First and second releasable pivot connections may be provided that respectively couples the top section to the first side section and the second side section. An outer groove of the sheave may be made accessible to receive the fixed-end cable when the first side section is splayed apart from the second side section on the sheave. The snatch block may be loaded or unloaded when the snatch block is lying flat on the ground.

BRIEF DESCRIPTION OF THE DRAWINGS

Embodiments of the system are described with reference to the several figures of the drawings, in which.

DETAILED DESCRIPTION OF VARIOUS EMBODIMENTS

Referring now to the figures of the drawings, the figures comprise a part of this specification and illustrate exemplary embodiments of the described system. It is to be understood that in some instances various aspects of the system may be shown schematically or may be exaggerated or altered to facilitate an understanding of the system.

Figure 1:
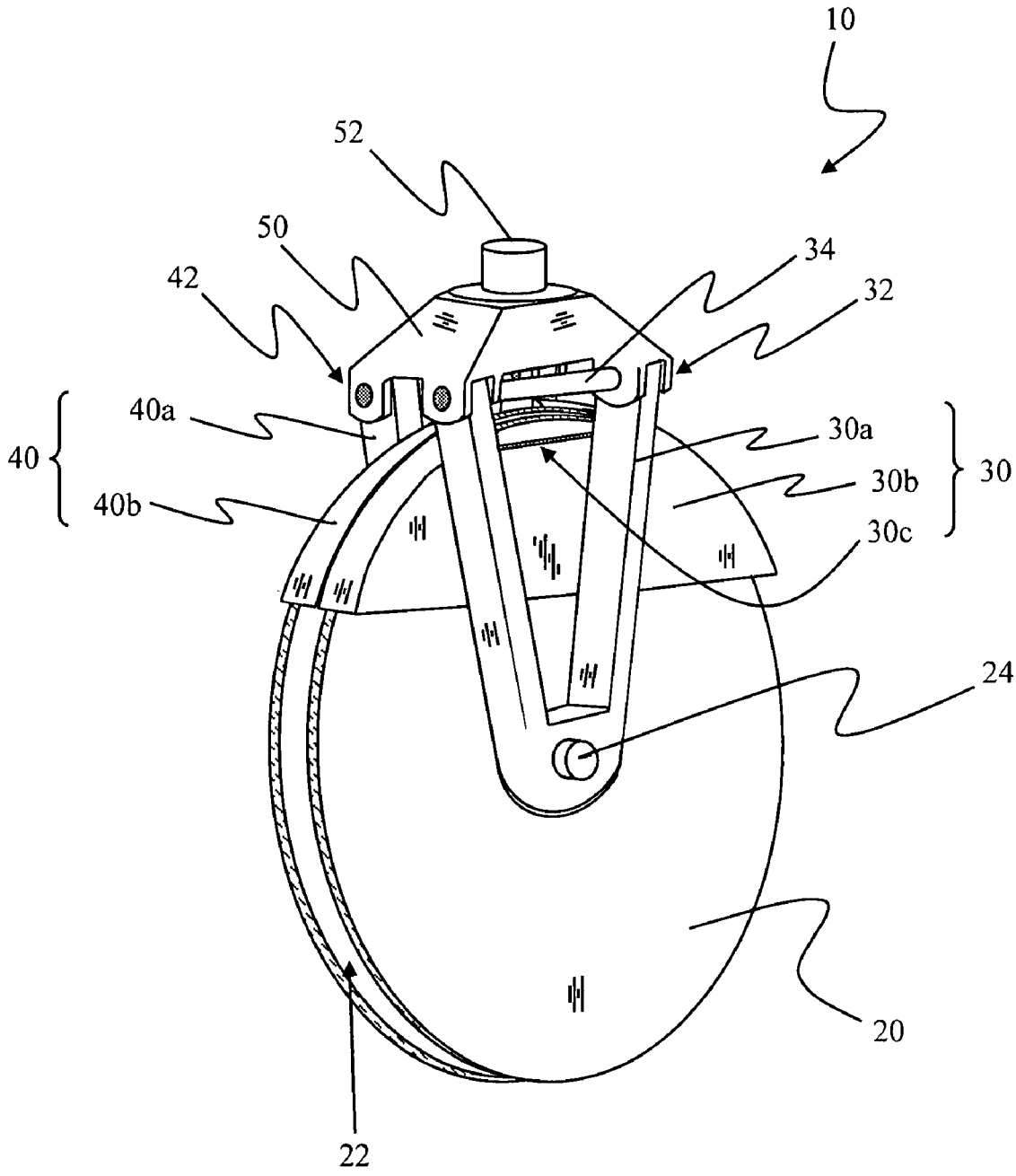
FIG. 1 is a schematic illustration of an embodiment of a snatch block according to the system described herein.

FIG. 1 is a schematic illustration of an embodiment of a snatch block 10 according to the system described herein. The snatch block 10 includes a sheave 20 having a groove 22 which may receive a cable. The sheave 20 may be of any known design suitable for pulleys and include designs to minimize weight of the snatch block. Positioned on the side faces of the sheave 20 are two legs 30, 40 (or other side section component) that are attached to the sheave 20, for example at a central axis 24 thereof. The legs 30, 40 may be secured to the central axis 24 via a nut or other fastener. As shown, each of the legs 30, 40 may include a v-shaped portion 30*a*, 40*a*, coupled to the central axis 24 and a top piece 50, and may include a semicircular portion 30*b*, 40*b* positioned over the groove 22 of the sheave 20. As discussed elsewhere herein, the semicircular portion 30*b*, 40*b* may have a circumferential portion 30*c* thereof removed to allow for the extension of the cable through the splayed leg 30 during loading or unloading operations (see FIG. 3). Either or both of the legs 30, 40 may include a removed circumferential portion.

In an embodiment, one of the legs 30, 40 is rotatable about the central axis 24 of the sheave 20 such that the legs 30, 40 may be splayed open with respect to one another, as further described elsewhere herein. Each of the legs 30, 40 may include a pin rod 34, 44 that is inserted through holes in the v-shaped portion 30*a*, 40*a* and holes in the top piece 50 to form pivot connections 32, 42 of the legs 30, 40 with the top piece 50. In another embodiment, both legs 30, 40 are rotatable about the central axis 24 of the sheave 20. In a closed position, the legs 30, 40 are aligned and secured by the top piece 50. The top piece 50 may include an attachment 52 for a supporting hook or other mechanism to attach the snatch block 10 to a support structure. Note that in the closed position, the system described herein allows attachment of the top piece 50 and supporting hook apparatus 52 to both of the legs 30, 40 on either side of the sheave 20 thereby enhancing the strength and stability of the snatch block 10 during loading and unloading operations.

Figure 2:
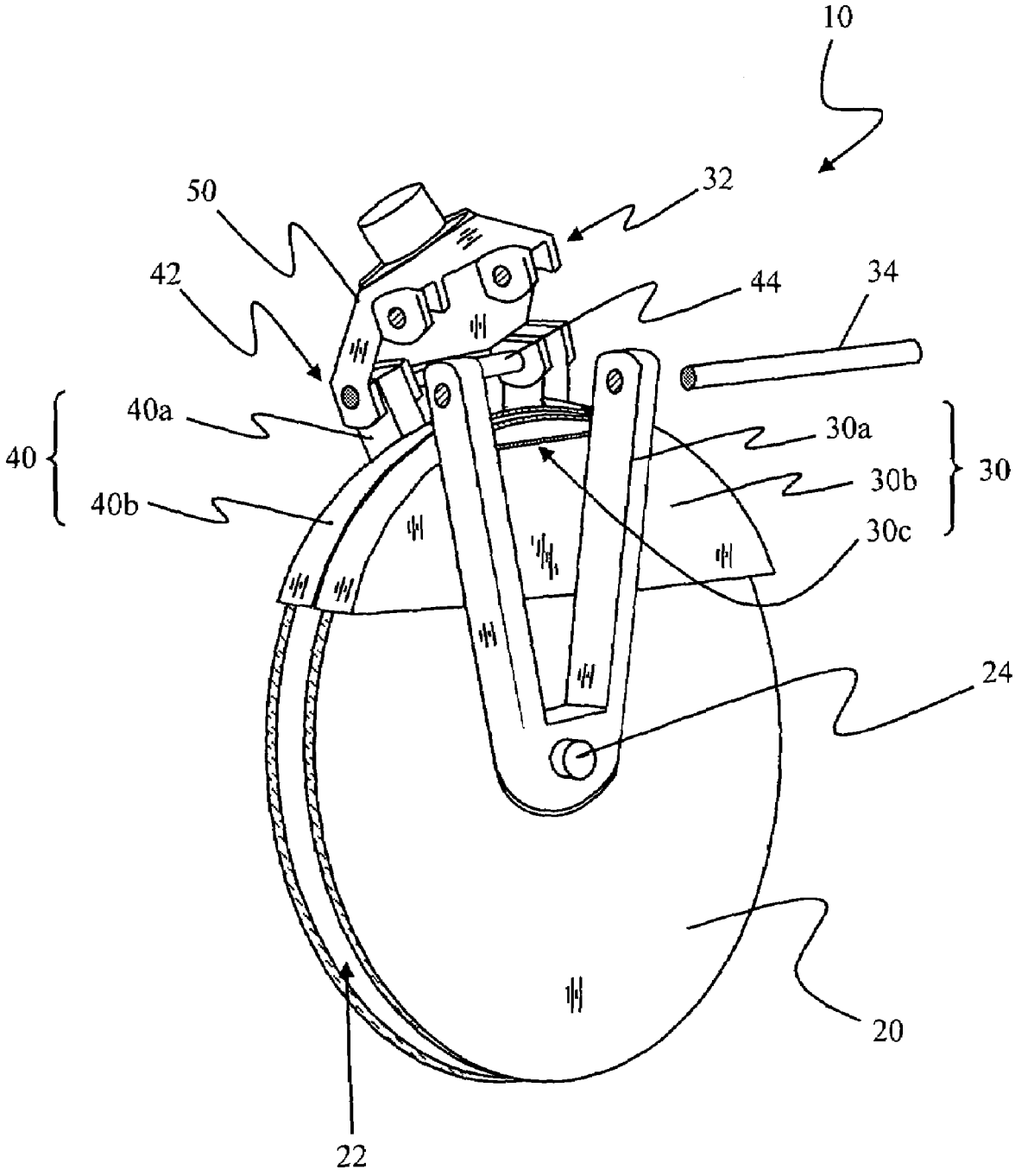
FIG. 2 is a schematic illustration of the snatch block showing a top piece of the snatch block that is no longer secured to one of the legs according to an embodiment of the system described herein.

FIG. 2 is a schematic illustration of the snatch block 10 showing the top piece 50 of the snatch block 10 that is no longer secured to one of the legs 30 according to an embodiment of the system described herein. As shown, the pin rod 34 has been removed from the pivot connection 32. Both of the legs 30, 40 may be attached to the top piece 50 by the pivot connections 32, 42 and the pivot connections 32, 42 may be the same connection type or different connection types. Alternatively, for a one-directional configuration, only one leg may be attached to top piece 50 by a pivot connection while the other leg may be coupled to the top piece 50 via a non-pivoting latching mechanism that allows only securing and/or unsecuring of the other leg to the top piece.

When one leg 30 is unsecured from the top piece 50, for example by removal of the pin rod 34 from the pivot connection 32 as shown, the top piece 50 may pivot away from the leg 30 using the pivot connection 42 of the top piece 50 to the other leg 40. The leg 30 may then be rotated about the central axis 24 of the sheave 20 thereby splaying the legs 30, 40 apart and allowing a cable to be loaded onto the snatch block 10, as further described elsewhere herein. It should be noted that while the pivot connection is a shown as a removable pin rod, other pivot connections and mechanisms of securing the connections are possible. For example, a bearing hinge and latch system may be used.

Figure 3:
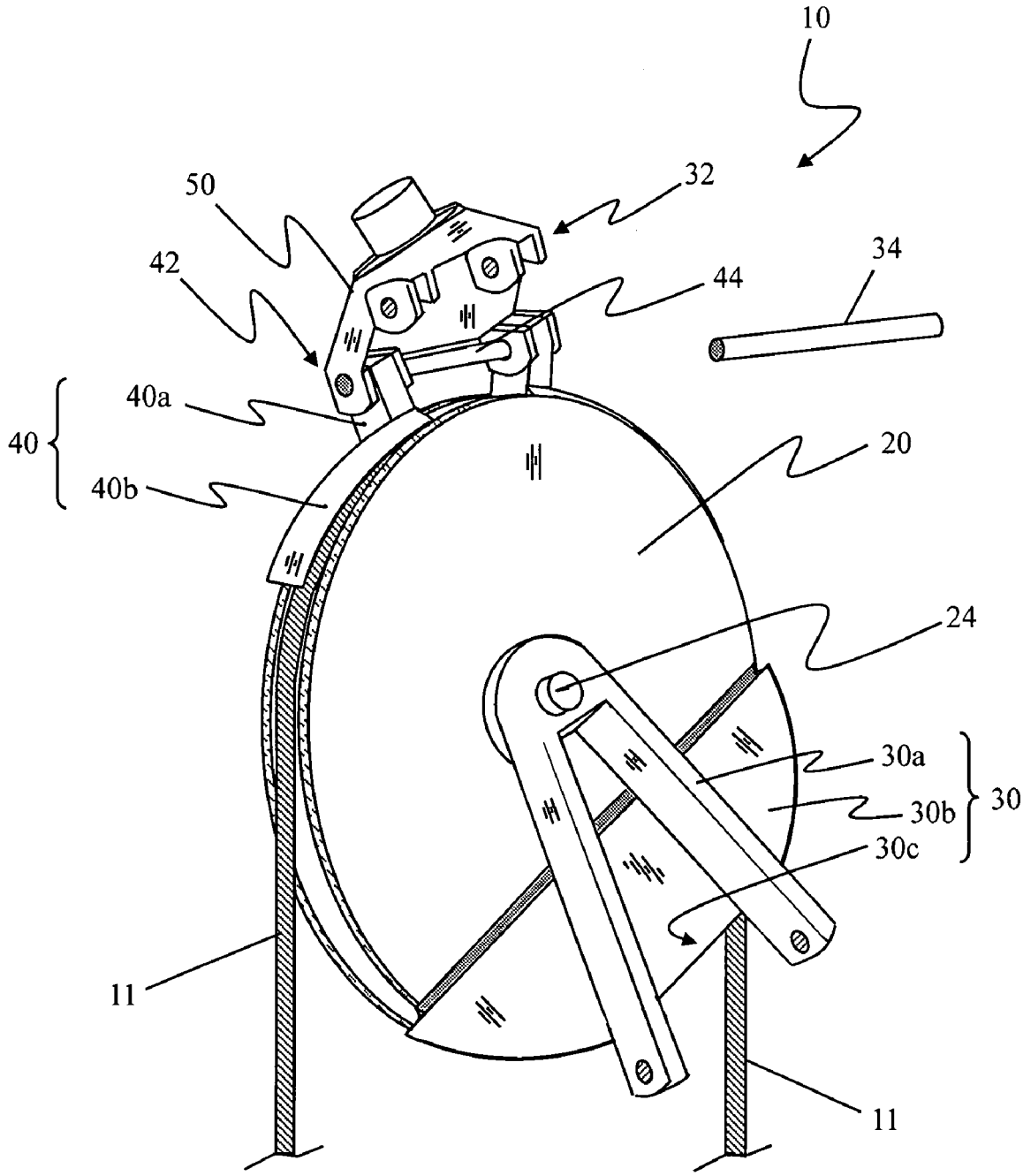
FIG. 3 is a schematic illustration of the snatch block showing the two legs splayed apart from one another by rotation of one leg with respect to the other leg about the central axis of the sheave according to an embodiment of the system described herein.

FIG. 3 is a schematic illustration of the snatch block 10 showing the two legs 30, 40 splayed apart from one another by rotation of one leg 30 with respect to the other leg 40 about the central axis 24 of the sheave 20. The pivoting action of the top piece 50 and the splaying of the two legs 30, 40 allow access to the snatch block 10 such that a fixed-end cable 11 may be loaded onto the snatch block 10 relatively easily and without undue manipulation of the snatch block 10 or the cable 11. In particular, the configuration of the snatch block described herein allows loading and unloading of the snatch block from a horizontal ground position. As shown, the cable 11 may extend through the splayed leg 30 as a result of the removed circumferential portion 30*c* of the semicircular portion 30*b* thereby allowing the splayed leg 30 to be disposed in multiple positions on the sheave during loading and unloading operations. Some adjustment of the position of cable 11 and/or snatch block 10 may be made when the leg 30 is realigned with the leg 40. Note that the system described herein may work with any type of cable including, without limitation, ropes, chains, cords and/or other type of flexible line.

Figure 4:
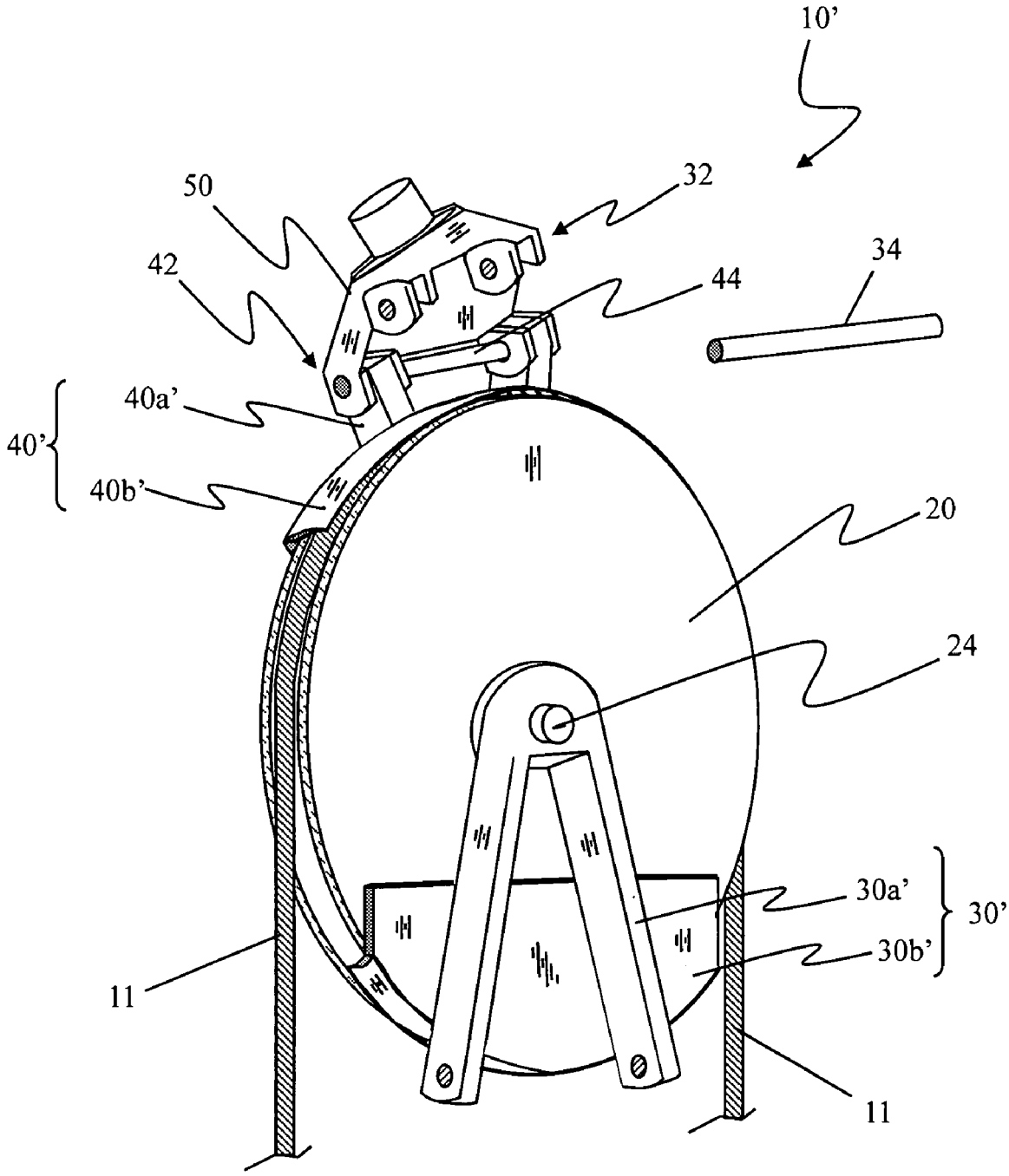
FIG. 4 is a schematic illustration of another design of the legs of the snatch block according to an embodiment of the system described herein.

FIG. 4 is schematic illustration of a snatch block 10' according to another embodiment of the system described herein. As discussed in reference to FIG. 3, the semicircular portion 30*b*, 40*b* of legs 30, 40 may be designed with a circumferential portion 30*c* removed to allow for the cable 11 to extend through the splayed leg 30 as the cable during loading or unloading of the cable 11 onto the snatch block 10. Alternatively, as shown in FIG. 4, a snatch block 10' may include alternative designs for legs 30', 40' with alternative semicircular portions 30*b*', 40*b*' and/or v-shaped portions 30*a*', 40*a*'. For example, the semicircular portion 30*b*', 40*b*' in each of legs 30' and 40' may not have a circumferential portion removed and instead the semicircular portion 30*b*', 40*b*' are designed to have a transverse length that is smaller than the diameter of the sheave 20. Accordingly, during loading and unloading operations, the leg 30' may be rotated on the sheave 20 to a position that allows the cable 11 to extend away from the snatch block 10' without obstruction. Some adjustment of the position of the cable 11 and/or snatch block 10' may be made when the leg 30' is realigned with the leg 40'.

Figure 5A:
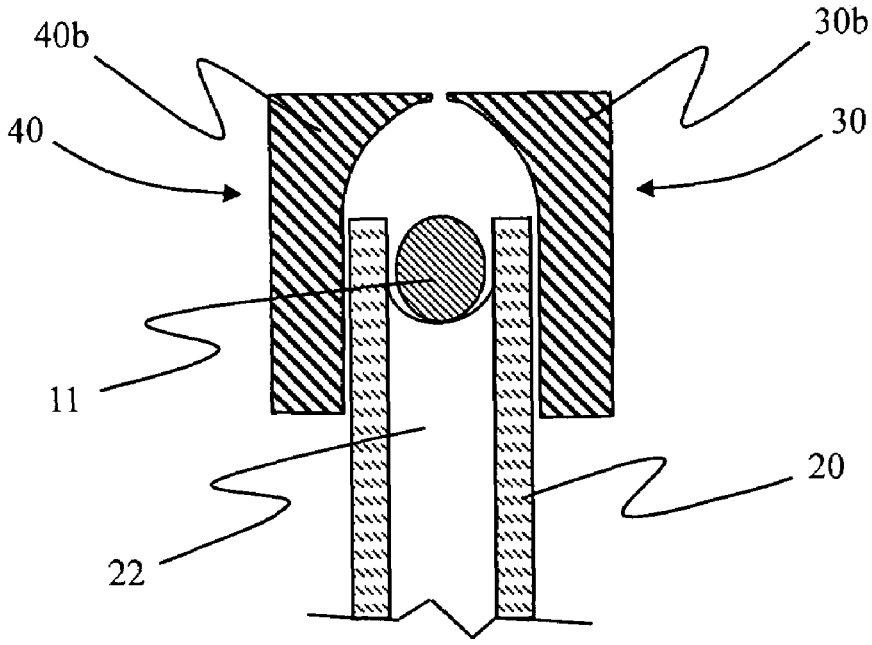
FIGS. 5A and 5B are cross-sectional views of the snatch block according to an embodiment of the system described herein.
Figure 5B:
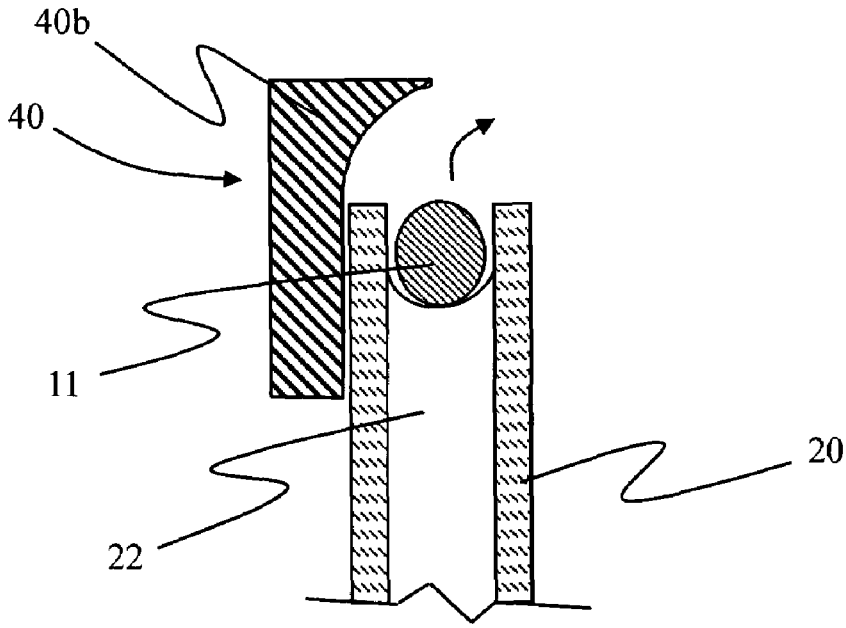

FIGS. 5A and 5B are cross-sectional views of the snatch block 10 according to an embodiment of the system described herein. FIG. 5A is a cross-sectional view of the semicircular portions 30*b*, 40*b* of the two legs 30, 40 of the snatch block 10 positioned on either side of the sheave 20. As shown, the profiles of each of the semicircular portions 30*b*, 40*b* of each of the legs 30, 40 are designed to allow the cable 11 to be received into the groove 22 of the sheave 20 when the legs 30, 40 are splayed apart. For example, the profiles of the semicircular portions 30*b*, 40*b* of legs 30, 40 have a half-arch configuration. As shown in FIG. 5B, when the legs 30, 40 are splayed apart, the cable 11 may be removed or received through the half arch opening. Each of the profiles may have dimensions that are of sufficient extent for the cable having fixed ends to be loaded into or removed from the groove 22. Other profile configurations are possible that would allow the cable 11 to be received into the groove 22.

According to the system described herein, the snatch block 10 may be loaded with a cable while the snatch block 10 is lying flat on the ground. This configuration provides for ease of loading of the cable without the need for extensive operator manipulation of the snatch block or cable. Operators do not have to support the weight of the snatch block 10 before loading the snatch block 10 with the cable and may not have to manually relieve tension on the cable when arranging snatch blocks. Further, the system described herein may operate such that either side of the snatch block 10 may be loaded thereby providing improved flexibility of the snatch block 10. Further, the snatch block 10 according to the system described herein may be intrinsically lighter because moving parts in the load path are minimized. In an embodiment herein, the snatch block according to the system described herein is made of metal and/or other materials suitable for a line load capability of up to 20,000 pounds.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A snatch block, comprising:

a sheave having a first side, a second side, and a central axis;

a first section disposed on the first side of the sheave;

a second section disposed on the second side of the sheave, wherein at least one of the first section and the second section is splayable apart with respect to the other one of the first section and the second section about the central axis of the sheave; and a top section that receives the first section and the second section, wherein the top section is releasably coupled to at least one of the first section and the second section and pivotably coupled to at least an other one of the first section and the second section, wherein, when loading or unloading a cable on or from the snatch block, the top section pivots away from the one of the first section and the second section, and the one of the first section and the second section splays apart from the other of the first section and the second section.

2. The snatch block according to claim 1, wherein at least one of the first section and the second section is rotatable about the central axis of the sheave.

3. The snatch block according to claim 2, wherein both the first section and the second section are rotatable about the central axis of the sheave.

4. The snatch block according to claim 1, wherein the sheave includes an outer groove and wherein portions of the first section and the second section are disposed over the outer groove.

5. The snatch block according to claim 4, wherein a profile of the first section over the outer groove and a profile of the second section over the outer groove each has dimensions that allow loading of a fixed-end cable into the outer groove.

6. The snatch block according to claim 1, further comprising:

a first releasable pivot connection that couples the top section to the first section; and a second releasable pivot connection that couples the top section to the second section.

7. The snatch block according to claim 6, wherein each of the first and second releasable pivot connections include a pin rod.

8. The snatch block according to claim 1, wherein an outer groove of the sheave is made accessible to receive a fixed-end cable when the first section is splayed apart from the second section.

9. The snatch block according to claim 1, wherein the snatch block is loadable or unloadable when the snatch block is lying flat on the ground.

10. A snatch block, comprising:

a sheave having a first side, a second side, and a central axis;

a first section disposed on the first side of the sheave;

a second section disposed on the second side of the sheave, wherein at least one of the first section and the second section is splayable apart with respect to the other one of the first section and the second section; and a top section that receives the first section and the second section, wherein the top section is releasably coupled to at least one of the first section and the second section and pivotably coupled to at least an other one of the first section and the second section, wherein each of the first section and the second section include:

an attachment portion coupled to the sheave and the top section; and a cover portion coupled to the attachment portion and including a least a portion disposed over an outer groove of the sheave.

11. The snatch block according to claim 10, wherein the attachment portion is v-shaped and the cover portion is semicircular.

12. A method for loading or unloading a snatch block, comprising:

providing a snatch block having a sheave, a first side section, a second side section, and a top section;

uncoupling the top section from a selected one of the side sections;

pivoting the top section away from the selected one of the side sections; and splaying the selected one of the side sections apart with respect to the other of the side sections about a central axis of the sheave to allow a fixed-end cable to be loaded onto or unloaded from the sheave.

13. The method according to claim 12, wherein at least one of the first section and the second section is rotatable about the central axis of the sheave.

14. The method according to claim 13, wherein the top section is pivotable with respect to either of the side sections.

15. The method according to claim 12, wherein the top section is pivotable with respect to both of the side sections.

16. The method according to claim 12, wherein both of the first side section and the second side section are rotatable about the central axis of the sheave.

17. The method according to claim 12, further comprising:

after loading or unloading the fixed-end cable, rotating the selected one of the side sections into alignment with the other of the side sections; and recoupling the top section to the selected one of the side sections.

18. The method according to claim 12, further comprising:

providing a first releasable pivot connection that couples the top section to the first side section; and providing a second releasable pivot connection that couples the top section to the second side section.

19. The method according to claim 12, wherein an outer groove of the sheave is made accessible to receive the fixed-end cable when the first side section is splayed apart from the second side section on the sheave.

20. The method according to claim 12, wherein the snatch block is loaded or unloaded when the snatch block is lying flat on the ground.

* * * * *